United States Patent [19]

Mima

[11] 4,411,128

[45] Oct. 25, 1983

[54] METHOD AND APPARATUS FOR SPLICING SPUN YARNS

[75] Inventor: Hiroshi Mima, Joyo, Japan

[73] Assignee: Murata Kikai Kabushiki Kaisha, Japan

[21] Appl. No.: 304,848

[22] Filed: Sep. 23, 1981

[30] Foreign Application Priority Data

Sep. 26, 1980 [JP] Japan ..... 55-134986

[51] Int. Cl.[3] ..... D01H 15/00

[52] U.S. Cl. ..... 57/22; 57/261; 242/37 A

[58] Field of Search ..... 57/22, 23, 261, 262, 57/263, 301, 302; 242/35.5 R, 35.6 R, 147 A, 37 A

[56] References Cited

U.S. PATENT DOCUMENTS

| | | | |
|---|---|---|---|
| 3,474,615 | 10/1969 | Irwin et al. | 57/22 X |
| 3,487,618 | 1/1970 | Arguelles | 57/22 |
| 3,599,886 | 8/1971 | Koller | 242/35.5 X |
| 3,732,678 | 5/1973 | Berry | 57/22 |
| 3,867,810 | 2/1975 | Mertens et al. | 57/22 X |
| 3,949,946 | 4/1976 | Rohner et al. | 242/35.6 X |
| 4,121,409 | 10/1978 | Uchida et al. | 57/22 |
| 4,263,775 | 4/1981 | Mima | 57/261 X |

FOREIGN PATENT DOCUMENTS

| | | | |
|---|---|---|---|
| 244973 | 4/1975 | Fed. Rep. of Germany | 242/147 A |

*Primary Examiner*—Donald Watkins

*Attorney, Agent, or Firm*—Spensley, Horn, Jubas & Lubitz

[57] ABSTRACT

Pneumatic yarn splicing method and apparatus for spun yarns. Suction nozzles for controlling yarn ends are arranged on both the sides of a splicing nozzle with a nozzle hole for jetting a compressed fluid. The sucking action of the yarn end control nozzle is stopped when or after the treatment of the yarn ends is completed, and then, a compressed fluid is jetted from the splicing nozzle to effect splicing.

9 Claims, 28 Drawing Figures

FIG. 10
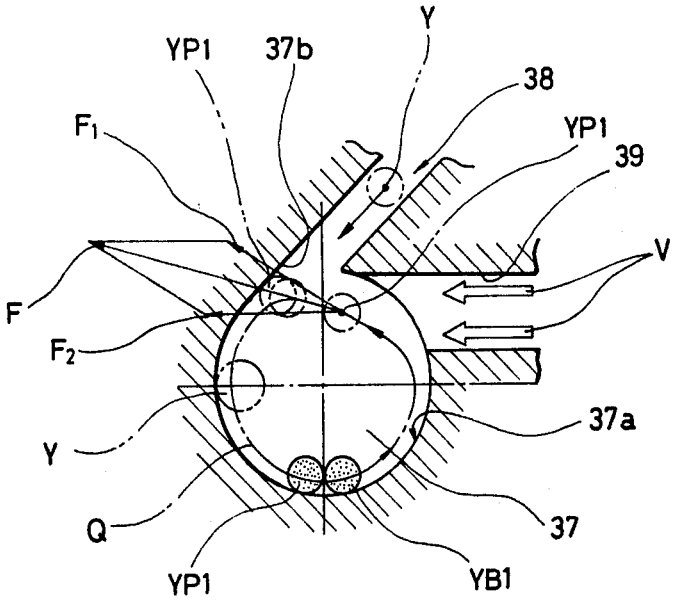
FIG. 11-a
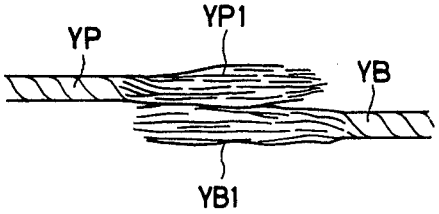
FIG. 11-b
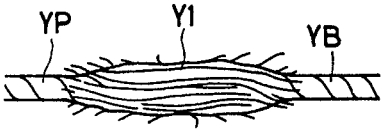
FIG. 11-c
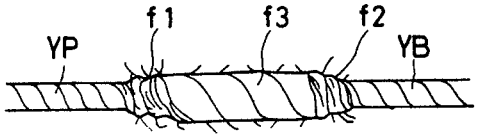
FIG. 11-d
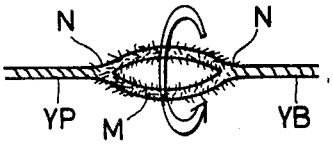

FIG. 15
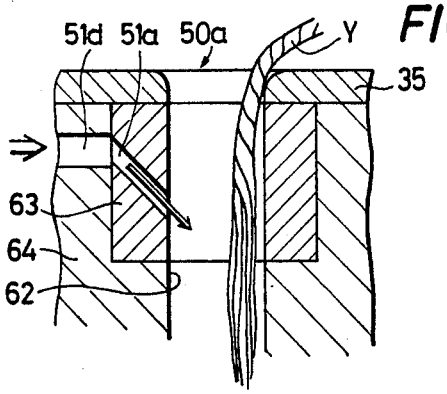
FIG. 18-a FIG. 18-b
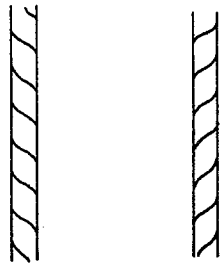
FIG. 16
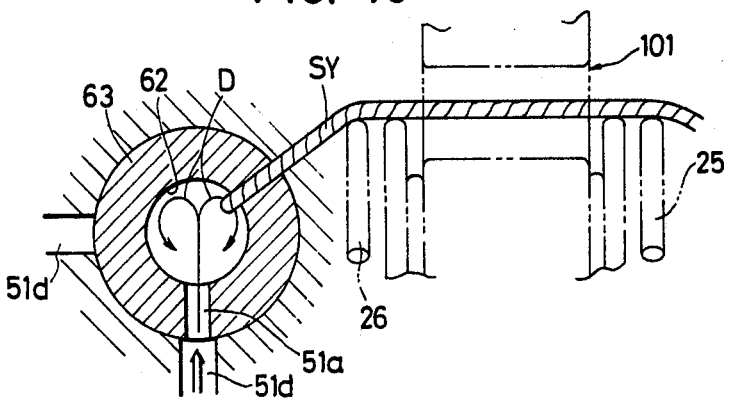
FIG. 17
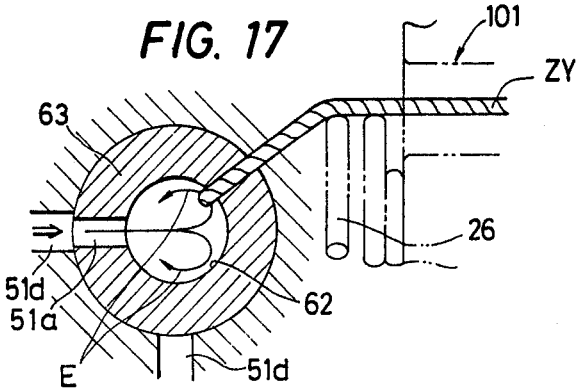

METHOD AND APPARATUS FOR SPLICING SPUN YARNS

BACKGROUND OF THE INVENTION

As the known method for tying spun yarns, there can be mentioned fisherman's knot and weaver's knot. In these knotters, the knotting operation heretofore conducted manually by a worker is performed only mechanically and the structure of the formed knot is not different from that of the knot manually formed by the worker. Such fisherman's or weaver's knot can comply with mass production by mechanization, but since increase of the knot strength alone is mainly intended in such yarn-tying apparatus, the size of the knot becomes as large as about 3 times the diameter of the single yarn, and any particular consideration is not paid to this increased size of the knot. This has series influences on the subsequent processing steps. For example, the size of the knot which is about 3 times the diameter of the single yarn causes breakage on knitting needles at the knitting step, inhibiting continuous operation of the machine, and a perforated knitted fabric is readily formed. Furthermore, in an air or water jet room, the yarn end projecting from a weft falls in contact with a warp forming a shed and there occurs an undesirable phenomenon in which the weft does not arrive at the fabric end. Moreover, knots appearing on the woven fabric as the final product are regarded as defects and it is necessary to perform a post treatment of removing a knot-appearing portion from the woven fabric or pushing the knots toward the back side of the fabric.

As means for eliminating the foregoing defects, there has been proposed a yarn-splicing apparatus which provides a knot structure quite different from the knot structure produced by the fisherman's knotter or weaver's knotter. According to this proposal, a fluid is jetted on lapped yarn ends to mingle the yarn ends and entangle fibers of the yarn ends to effect splicing. After the yarn ends have been mingled with each other, the fibers of both the yarn ends are entangled with one another and certain twists are given to the fibers, whereby an integrated joint structure is formed.

As pointed out hereinbefore, the size of the knot formed by the fisherman's or weaver's knotter is at least about 3 times the diameter of the single yarn. In contrast, the size of the knot formed by the air splicer is not larger than about 1.5 times the diameter of the single yarn. Supposing that the ends of a single yarn having a diameter $d_1$ and a sectional area $A_1$, are spliced by the air splicer to form a joint having a diameter $d_2$ and a sectional area $A_2$, since $A_1$ is equal to $(\pi/4)d_1^2$ and $A_2$ is equal to the sum of the sectional areas of the two single yarns, $A_2$ is expressed as follows:

$$A_2=(\pi/4)d_1^2+(\pi/4)d_1^2 \quad (1)$$

or $$A_2=(\pi/4)d_2^2 \quad (2)$$

From the formula (1) and (2), the following relation is derived:

$$\frac{\pi}{4}d_1^2+\frac{\pi}{4}d_1^2=\frac{\pi}{4}d_2^2$$

-continued $$\frac{\pi}{2}d_1^2=\frac{\pi}{4}d_2^2$$

$$d_2=\sqrt{2}\,d_1$$

Accordingly, the size d of the joint is $\sqrt{2}$ times the size d.

The above value is a theoretical value calculated based on the supposition that the two single yarns d1 are completely mingled with each other and the joint has a shape of a true circle. It is estimated that practically, the joint is elliptical more or less. Accordingly, it is estimated that the maximum size of the joint is somewhat larger than $\sqrt{2}$ times the single yarn diameter d1. However, at any rate, this size is about ½ of the size of the fisherman's or weaver's knot, which is about 3 times the single yarn diameter. Therefore, this splicing method can be regarded as an epoch-making yarn tying method.

However, there is disadvantage that the binding strength of the joint spliced by the above pneumatic yarn splicing method is smaller than the binding strength of the fisherman's or weaver's knot. That is, in case of the fisherman's or weaver's knot, it is considered that in principle, the binding strength is equal to or higher than the single yarn strength, though in certain yarns, for example, a polyester/cotton mix-spun yarn or an acrylic yarn etc., it happens that the binding strength is lower than the single yarn strength. While, in each of joints formed by various air splicer, the binding strength is lower than the single yarn strength, though the binding strength differs depending on the kind of yarn, the count number of the yarn or length of fibers consisting the spun yarn. Influences of the count number of the yarn on the binding strength of the knot are especially prominent. More specifically, as the size of the yarn is small, the ratio of the binding strength of the joint to the single yarn strength is relatively high, and a value of 70 to 85% was obtained at experiments.

On the other hand, as the size of the yarn is increased, the above-mentioned ratio is decreased and it often happens that the binding strength is less than 50 % of the single yarn strength. Furthermore, it is pointed out that even if the count number is the same, the binding strength varies according to the condition of the joint and there are protrusions at the vicinity of the spliced joint.

We previously proposed in U.S. Pat. No. 4,263,775 a pneumatic splicing method and apparatus in which suction nozzles are arranged on both the side of a splicing nozzle, yarn ends on both the bobbin and package sides are exposed in a free state to an action of suction streams and then, they are subjected to an action of the splicing nozzle under the action of the suction streams.

The present invention relates to an improvement in the splicing method and apparatus proposed in the above U.S. Pat. No. 4,263,775.

As another related prior art techniques, there can be mentioned those disclosed in U.S. Pat. Nos. 3,474,615; 3,487,618; 3,599,886; 3,732,678; 3,867,810; 3,949,946 and 4,121,409, and West German Pat. No. 244,973, which were cited in the examination of the above U.S. Pat. No. 4,263,775.

SUMMARY OF THE INVENTION

The present invention relates to an improved method and apparatus for splicing spun yarns.

It is a primary object of the present invention to provide a stable splicing method and apparatus in which a binding strength comparable to or excellent over the binding strength of the conventional fisherman's knot or weaver's knot is obtained while removing protrusions from the vicinity of the spliced joint.

Our previous proposal made in the above U.S. Pat. No. 4,263,775 is a basic proposal including an embodiment in which the yarn ends are subjected to the sucking action throughout the operation time of a splicing nozzle and an embodiment in which the yarn ends are subjected to the sucking action only during the initial stage of the operation of the splicing nozzle. However, it has been found that in relation to the sucking action of the yarn end control nozzle and the jetting action of the splicing nozzle, it is difficult to produce a state in which the tops of the yarn ends are taken out from the yarn end control nozzle at a sufficiently early stage and the tops of the yarn ends are exposed only to the action of the splicing nozzle. Accordingly, joints insufficient in winding on both the tops of the spliced yarn ends in the spliced yarn were often obtained. In such joints, the tensile strength is insufficient and the appearance is inferior. Of course, because of such disadvantage, the utility of out previous invention is not impaired and great functional effects of the yarn end control nozzle according to this previous proposal are not denied at all.

The present invention provides an improvement in our previous proposal in which the sucking action of the yarn end control nozzle is stopped when or after the treatment of the yarn ends on both the bobbin and package sides is completed, and then, a compressed fluid is jetted from the splicing nozzle to effect splicing. As will be apparent from the following detailed description, although an instruction for stopping the operation of the yarn end control nozzle is given simultaneously with initiation of the jetting action of the splicing nozzle or at the early stage thereof, it is not true that the sucking action is completely lost as soon as the instruction for stopping the yarn end control nozzle is given.

BRIEF DESCRIPTION OF THE DRAWINGS

FIG. 10 and FIGS. 11-*a* through 11-*d* are diagrams illustrating embodiments of the splicing operations.

FIGS. 14 and 15 are longitudinal sectional views illustrating a control nozzle.

FIGS. 16 and 17 are sectional partial views of the control nozzle.

FIGS. 18-*a* and 18-*b* are diagrams illustrating twisting directions in yarns.

DETAILED DESCRIPTION OF THE INVENTION

The present invention will now be described in detail with reference to the accompanying drawings.

Figure 2:
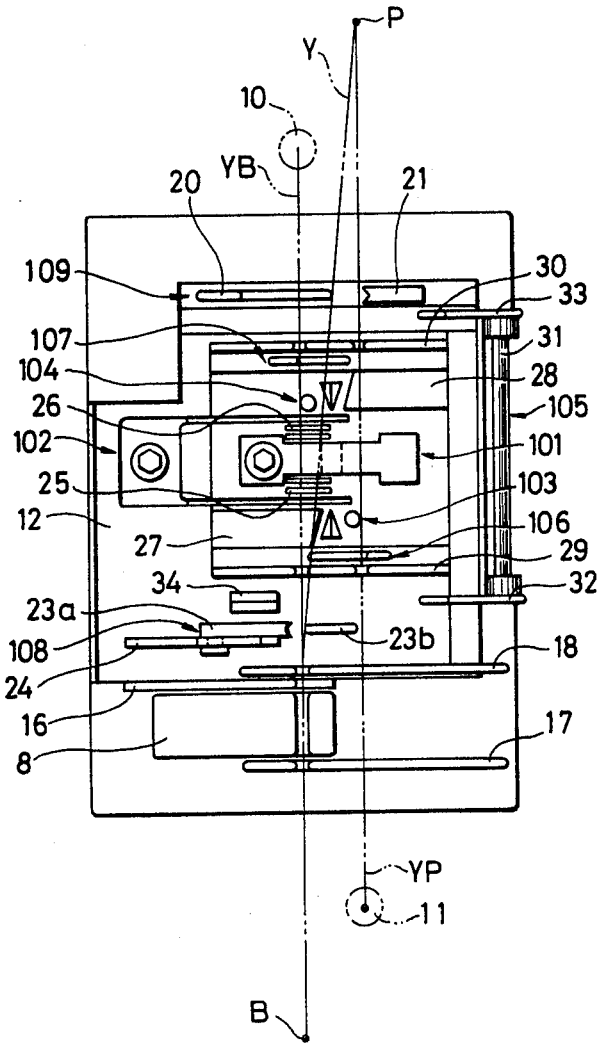
FIG. 2 is a side view illustrating the entire structure of the splicing apparatus.

FIG. 2 is a view diagrammatically illustrating an automatic winder to which the present invention is applied. Referring to FIG. 2, a shaft or pipe 2 and a suction pipe 3 are laid out between every two adjacent frames 1 and a winding unit 4 is rotatably supported on the shaft 2. While the automatic winder is operated, the winding unit 4 is placed also on the pipe 3 and appropriately fixed. The pipe 3 is connected to a blower not shown in the drawings and a suction air current always acts on the pipe 3.

In the above-mentioned winding unit 4, rewinding of a yarn to a package P from a bobbin B is conducted in the following manner. More specifically, a yarn Y1 is unwound from the bobbin B on a peg 5 and guided to a tenser 7 through a guide 6, and an appropriate tension is given to the yarn Y1 by the tenser 7. Then, the yarn Y1 passes through a detector 8 detecting yarn unevenness such as slub and also detecting breakage or running of the yarn, and it is then wound onto the package P rotated by a winding drum 9.

When yarn unevenness is detected by the detector 8, a cutter located in the vicinity of the detector 8 is actuated to cut the running yarn Y1 and stop the winding operation. Simultaneously, a first yarn guide suction arm 10 is actuated to guide a yarn YB on the bobbin side to a yarn splicing apparatus 12 located apart from the ordinary yarn path Y1 and a second guide suction arm 11 is actuated to guide a yarn on the package side to the yarn-splicing apparatus 12. Then, the splicing operation is conducted by the yarn-splicing apparatus 12, and rewinding of the yarn is then started again and continued. The first and second yarn guide suction arms 10 and 11 are connected to the pipe 3 on which the suction air stream acts. Since a fluid such as compressed air is used for the yarn-splicing apparatus, a conduit 14 is laid out between another pipe 13 and a yarn-splicing box 15 and the compressed fluid is supplied to the yarn-splicing apparatus from the pipe 13.

Figure 3:
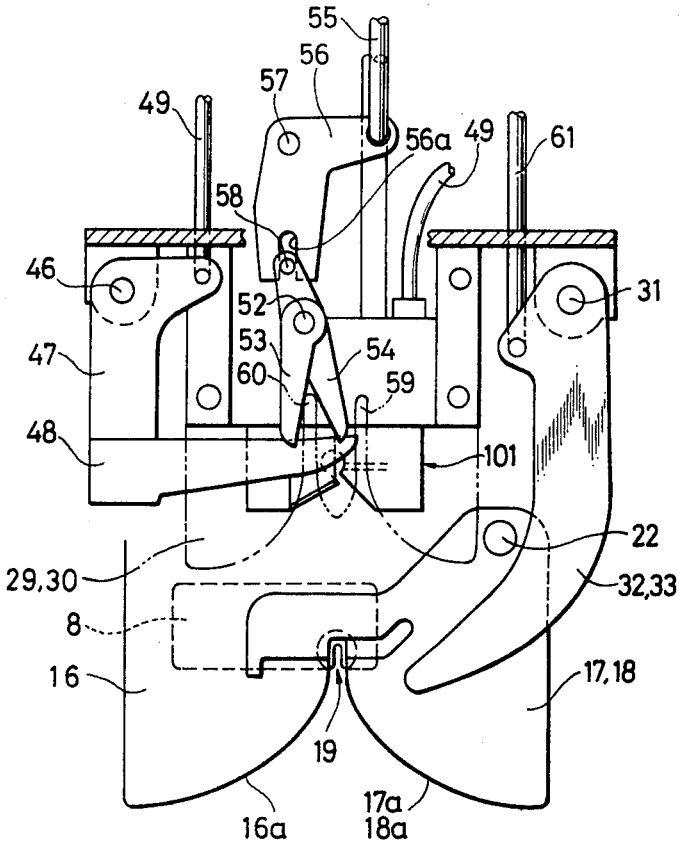
FIGS. 3 through 5 are plan views illustrating the structure of the splicing apparatus.

The entire structure of the yarn-splicing apparatus 12 is illustrated in detail in FIGS. 2 and 3. During the normal rewinding operation, a yarn Y from the bobbin B passes through the detector 8, a fixed guide 16 disposed at one end of the detector 8 and turning guides 17 and 18 disposed before and after the detector 8 and runs along a course away from the splicing apparatus 12 to the package P.

The above-mentioned splicing apparatus 12 comprises as basic member a splicing member 101, a clamping device 102, control nozzles 103 and 104, a yarn gathering lever 105, yarn cutting devices 106 and 107 and yarn supporting devices 108 and 109. The suction openings on the top ends of the above-mentioned first and second suction arms 10 and 11 are turned above the splicing apparatus 12 so that they traverse each other, whereby the sucked yarn ends YB and YP on the sides of bobbin B and package P are traversed to the outside of the splicing apparatus 12 and stopped there.

Figure 4:
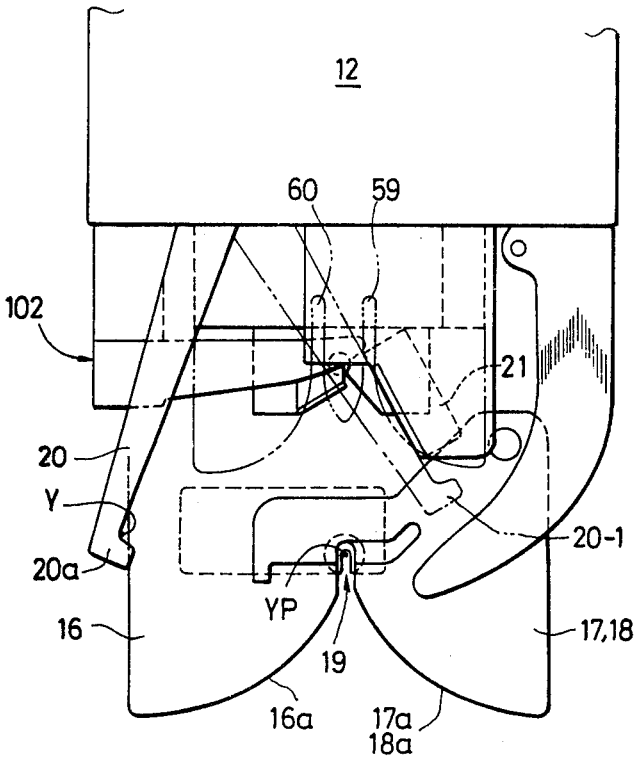

Incidentally, the first and second suction arms 10 and 11 are not simultaneously operated, but they are operated with a certain time lag. More specifically, at first, the yarn end YP on the package side P is turned to the outside of the splicing apparatus 12 by the suction arm 11 and the suction arm 11 is stopped, and substantially simultaneously, a turning lever 20 of the yarn supporting device 107 on the package side P is turned to as position 20-1 indicated by a chain line counterclockwise as shown in FIG. 4 by means of a control cam or the like (not shown) and is stopped when it is brought into abutting contact with a supporting block 21 fixed at a predetermined position. At this time, the yarn Y is moved while it is hung on a hook portion 20*a* of the turning lever 20 and the yarn Y is gripped between the support block 21 and the turning lever 20.

Figure 5:
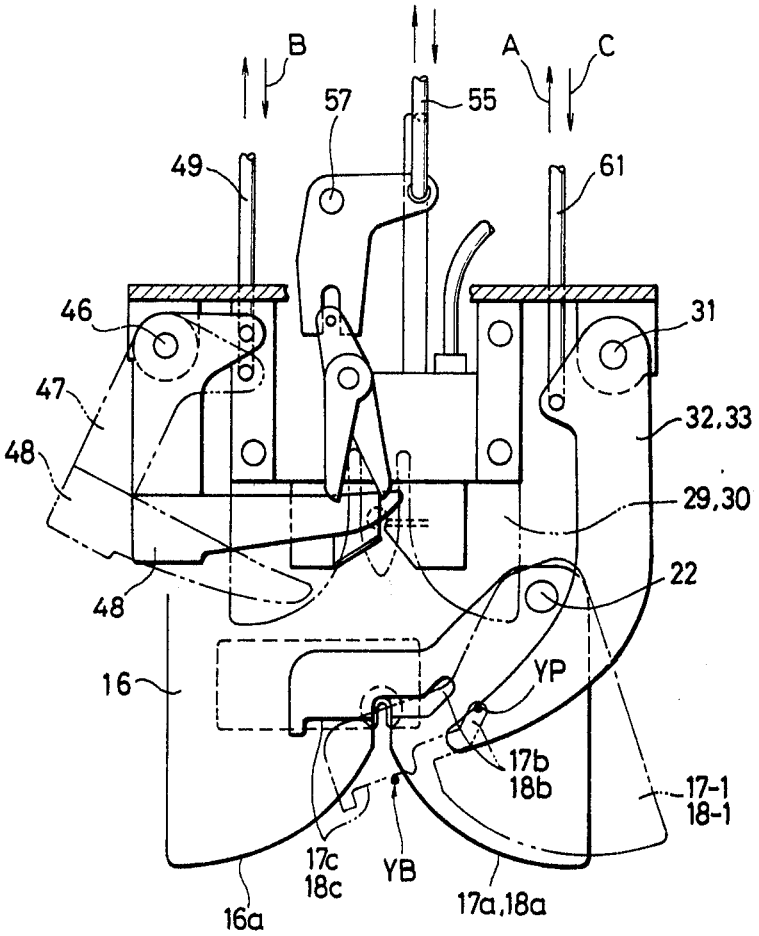

While the turning lever 20 is being operated, the yarn located on a stationary guide 16 and turning guides 17 and 18 is fitted in a guide groove 19 along inclined faces 16*a*, 17*a* and 18*a* of the guides 16, 17 and 18. A detecting device 8 is disposed at the same position as that of the guide groove 19 to confirm the presence or absence of the yarn or detect whether or not the yarn ends YP of at least two yarns are erroneously sucked by the suction arm 11. After this confirmation, the turning guides 17 and 18 are turned counterclockwise with a shaft 22 being as the center by a control cam or the like (not shown) as shown in FIG. 5, and the yarn end YP is separated from the detecting device 8 and is fitted in escape grooves 17*b* and 18*b* of the turning guides 17 and 18.

Almost simultaneously with the turning movement of the turning guides 17 and 18, the yarn end YB on the bobbin side B is sucked by the suction arm 10, and the suction arm 10 is turned in the direction opposite to the turning direction of the suction arm 11 and stopped on the outside of the splicing apparatus 12. Almost simultaneously with stopping of the turning movement of the suction arm 10, a supporting plate 23*a* of the yarn supporting device 108 is moved in the same direction as the moving direction of the turning lever 20 along a guide plate 24 by a control cam or the like (not shown), and it is brought into abutting contact with a supporting block 23*b* fixed at a predetermined position, whereby the yarn Y is gripped between the supporting plate 23*a* and supporting block 23*b*. At this time, the yarn YB is hung on hook portions 17*c* and 18*c* formed in the vicinity of the top ends of the turning sides 17 and 18 by the turning movement thereof and checking at the detecting device 8 is performed after completion of the splicing operation.

The splicing member 101 is arranged substantially at the center of the splicing apparatus 12, and on both the sides of the splicing member 101, there are arranged in sequence yarn guide pins 25 and 26, clamping device 102, control nozzles 103 and 104, yarn guides 27 and 28, yarn cutting devices 106 and 107 and fork guides 29 and 30. Furthermore, on the side portion of the splicing member 101, there is disposed a yarn gathering lever 105 comprising a shaft 31 and lever 32 and 33 turning with the shaft 31 being as the center. After a slab or the like is detected in the yarn Y by the detecting device 8 to cut the yarn Y by the cutting device and both the yarn ends YP and YB are guided to the outside of the splicing apparatus 12 by the operation of the suction arms 10 and 11, the yarn gathering lever 105 guides the yarn ends YP and YB toward the splicing apparatus 12. The turning region of the yarn gathering lever 105 is defined by a stopper 34 having a substantially V-shaped section, which is disposed between the fork guide 29 and yarn supporting member 108. Namely, when the yarn gathering lever 105 is stopped when it abuts against the stopper 34. Accordingly, the turning region of the yarn gathering lever 108 can be adjusted by adjusting the position of the stopper 34.

The respective members and devices will now be described in detail one by one.

Referring to FIGS. 6 through 9, the splicing member located substantially at the center of the splicing apparatus 101 is screwed at a point 36 to a bracket 35, and a cylindrical splicing hole 37 is formed substantially at the center of the splicing member 101 and a slit 38 suitable for insertion of the yarn Y from the outside is formed throughout the tangential direction of the splicing hole 37. A jet nozzle 39 is formed so that it is opened tangentially to the splicing hole 37. In the present embodiment, a cylindrical nozzle hole 39 is formed along the longitudinal direction of the splicing hole 37 substantially at the center thereof, but the section of the nozzle hole 39 may have an oval, rectangular or long groove-like shape. Furthermore, a plurality of nozzle holes 39 may be formed. When the size of the yarn to be spliced is large, for example, the count number of the yarn is about 10 or larger, especially good results are obtained when the nozzle hole 39 has a laterally expanded section.

Control plates 42 and 43 are screwed to both the sides of the splicing member 101 through spacers 40 and 41, and the control plate 42 is disposed to cover substantially the half of the sectional area of the splicing hole 37.

The control plate 42 exerts a function of controlling a balloon formed by the action of a compressed fluid such as air, which is jetted from the hole 39 at the splicing operation, and the spacers 40 and 41 form spaces between walls 44 and 45 of the splicing member 101 and the control plates 42 and 43 so as to prevent the yarn Y from flying out with increase of the amount of the compressed fluid flowing toward the slit 38 after impinging against the walls of the control plates 42 and 43, and the amount of the fluid flowing out from the slit 38 is thus controlled.

The fluid is supplied to the jet nozzle hole 39 through the above-mentioned conduit 14.

The process for formation of a joint by splicing is illustrated in FIGS. 10 and 11.

The yarn ends YB and YP on both the bobbin and package sides B and P to be spliced are inserted from the slit 38 opened to one end of the splicing hole 37 and both the yarn ends YB and YP are placed in contact with the inner circumferential face 37*a* of the splicing hole 37 while confronting each other with respect to the opening of the slit 38. When a compressed fluid V is jetted into the splicing holes 37 in this state, the compressed fluid V flows along the inner circumferential face 37*a* of the splicing hole 37 and when the fluid V flows substantially along a half of the circle in the splicing hole 37, the fluid catches the respective yarn ends YB1 and turns in this state.

When the fluid V makes substantially one circle, the turning stream F1 is combined with a fluid streams F2 jetted from the jet nozzle hole 39 and the fluid flows with a combined force F of the turning stream F1 and jetted stream F2.

At this time, the yarn ends YB1 and YP1 to be spliced move along the locus Q of the fluid, but at the point when the turning stream F1 is combined with the jetted steam F2, the yarn end YB1 first abuts against the inner circumferential face 37*b* of the splicing hole 37 at a part slightly inner than the opening of the slit 38 and the yarn end YP1 is then moved while impinging against the yarn end YB1, whereby both the yarn ends YB1 and YP1 are mingled and integrated with each other. This operation of mingling and integrating both the yarn ends YB1 and YP1 with each other should be performed at the initial stage of ballooning of the yarn ends.

The reason is that when the yarn end Y1 formed by mingling and integration of both the yarn ends YB1 and YP1 is ballooned, the integrated yarn end Y1 is twisted and entanglements are given to both the sides of the twist, with the result that after certain ballooning, mingling of the yarn ends becomes difficult.

More specifically, as shown in FIG. 11-*a*, the yarn ends YB1 and YP1 to be spliced are untwisted by the splicing control nozzles 103 and 104 before they are introduced into the splicing hole 37, and the respective fibers are arranged substantially in parallel to one another. When the turning stream F1 is combined with the jetted stream F2 from the jet nozzle 39, both the yarn ends YP1 and YB1 are mingled and integrated with each other as shown in FIG. 11-*b*. Then, the respective fibers of both the yarn ends are strongly entangled with one another by the action of the turning stream as shown in FIG. 11-*c*, and between both the wrapped portions f1 and f2 twists f3 are given. Thus, the splicing operation is completed.

Incidentally, when both the yarn ends YP1 and YB1 are subjected to the action of the jetted fluid V, a balloon M is formed as shown in FIG. 11-*d*, and as the rotation number of the balloon is increased, the fibers in the vicinity of the balloon neck N are set free by the yarn swinging action of the balloon and yarn breakage is likely to occur. Accordingly, the balloon rotation number is adjusted to a level suitable for splicing by the above-mentioned balloon control plates 42 and 43.

Referring to FIGS. 2 and 3, the clamping device 102 arranged on both the sides of the splicing member 101 cooperate with the turning movement of the yarn gathering lever 105 detailed hereinafter at the time of splicing to take out the yarn ends YP1 and YB1 untwisted by the splicing control nozzles 103 and 104 and set them in the splicing hole 37 of the splicing member 101, and simultaneously, the cmamping device 102 regulate the positions of the yarns YP and YB. More specifically, the cmamping device 102 comprises a clamping plate 48 screwed to a turning lever 47 capable of turning with a shaft 46 fixed at a predetermined position being as the fulcrum and when a rod 49 is operated by a control cam or the like (not shown), the clamping plate 48 is turned as shown in FIG. 5.

Figure 12:
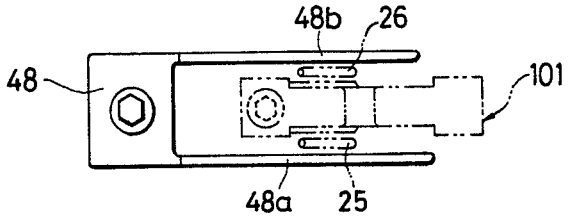
FIG. 12 is a side view illustrating a clamping plate in detail.
Figure 13:
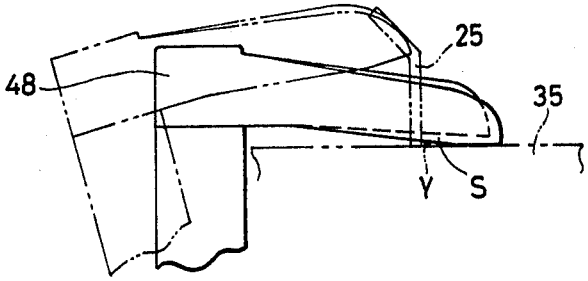
FIG. 13 is a plan view of the clamping plate.

The clamping plate 48 is illustrated in detail in FIGS. 12 and 13. The clamping plate 48 has fork-shaped portions 48*a* and 48*b* on the top end thereof, and the two fork-shaped portions 48*a* and 48*b* are somewhat different in the configuration. When the clamping device 48 is turned and one fork-shaped portion 48*a* abuts against the face of the bracket 35 to clamp the yarn Y by the top face of the bracket 35 between the yarn guide pin 25 and the fork-shaped portion 48*a*, a certain space S allowing passage of the yarn is formed among the other fork-shaped portion 48*b*, the top face of the bracket 35 and the yarn guide pin 26, and the position of the yarn Y is regulated only with respect to the rectangularly traversing direction.

When the yarn ends YB1 and YP1 are ballooned by the action of the compressed fluid at the splicing operation as pointed out hereinbefore, one yarn is untwisted by the ballooning action. The clamping action of the fork-shaped portion 48*a* of the clamping plate 48 is utilized for preventing this untwisting.

Accordingly, the clamping force is controlled to such an extent that the twists of the yarn Y are not removed. If the clamping force is too large, fluffs are readily formed and no good results can be obtained. Since the other yarn Y is turned in the twisting direction by the ballooning action, this yarn need not particularly be gripped and a clamping force regulating the position of the yarn Y is sufficient.

Figure 14:
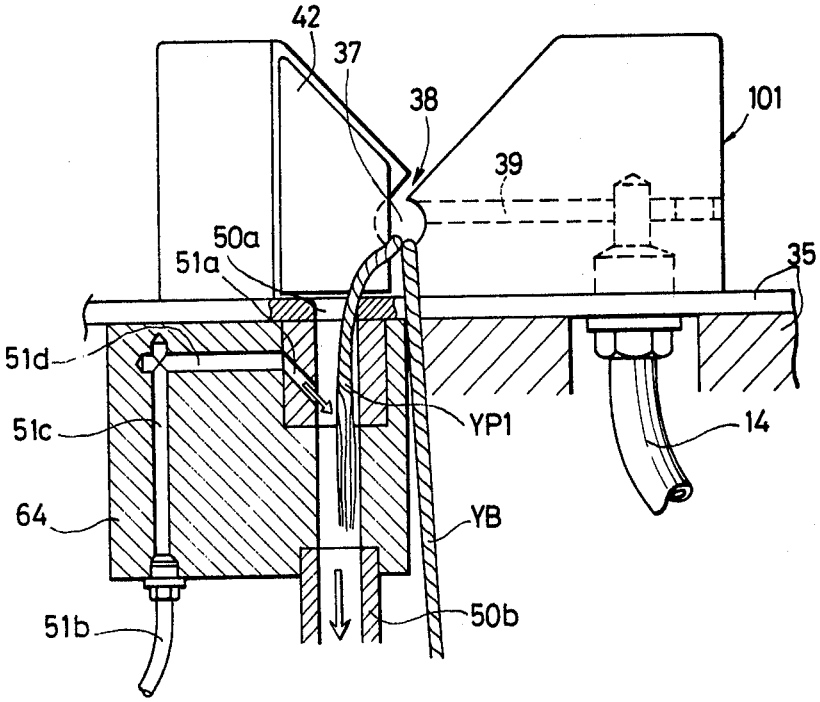

Nozzle holes 50*a* for untwisting the yarn ends YB1 and YP1 are formed on the yarn control nozzles 103 and 104 arranged on both the sides of the clamping device 102 as shown in FIG. 14, and the yarn ends YB1 and YP1 on both the bobbin and package sides B and P to be spliced are introduced to the nozzle hole 50*a* through the splicing hole 37 by the sucking action of the above-mentioned suction pipe 3 through a flexible pipe 50*b*. When the yarn end YP1 is guided into the nozzle hole 50*a*, the yarn end YP1 is untwisted by a fluid jetted from a jet nozzle 51*a* opened slantingly to the nozzle hole 50*a* and simultaneously, the respective fibers are arranged substantially in parallel to one another.

More specifically, referring to FIGS. 15 through 17 illustrating the nozzle hole 50*a* in detail, an end-free yarn Y inserted into a suction hole 62 is untwisted on the end portion thereof by a compressed fluid jetted from the jet nozzle 51*a* opened slantingly to a sleeve 63. Since Z twists or S twists are given to the yarn Y as shown in FIGS. 18-*a* and 18-*b* and the yarn Y is twisted in one of two opposite directions, the jetting direction of the jet nozzle 51*a* should be determined while taking the twisting direction of the yarn Y into account. Namely, in case of an S-twisted yarn SY, the turning stream jetted from the jet nozzle 51*a* should be generated in a direction indicated by arrow D in FIG. 16, that is, in the untwisting direction, and in case of a Z-twisted yarn ZY, the turning stream should be caused to act in a direction indicated by arrow E in FIG. 17, that is, in the direction opposite to the direction adopted for the S-twisted yarn. Accordingly, communicating holes 51*d* to be communicated with the jet nozzle 51*a* of the sleeve 63 are formed at a deviation angle of about 90° on supporting block 64 rotatably supporting the sleeve 63, so that both the S-twisted and Z-twisted yarns can be treated by turning the sleeve 63 by about 90°.

Furthermore, the jet nozzle 51*a* may be formed tangentially to a suction hole 62 so that a turning stream in a direction opposite to the twisting direction of the yarn is generated. Moreover, there may be adopted a modification in which a spiral groove or helical vane is formed on the inner wall of the suction hole 62 instead of the jet nozzle 51*a* and a turning stream is generated by the sucking action of the flexible pipe 50*b*. In this case, the swirling direction of the spiral groove or helical vane is determined according to the twisting direction of the yarn Y.

The above-mentioned nozzle hole 50*a* is effective for promoting untwisting of the yarn Y, but in principle, only the sucking action of the flexible pipe 50*b* is sufficient. The fluid is supplied to the jet nozzle 51*a* through a conduit 51*b* and communicating holes 51*c* and 51*d* by the pipe 13 connected through the above-mentioned conduit 14. The nozzle holes 50*a* of the control nozzles 103 and 104 have the same structure and function as those of the nozzle hole 50*a* of the jet nozzle 51*a*.

In the present embodiment, the jetting action of the jet nozzle 51*a* and the sucking action of the flexible pipe 50*b* are simultaneously utilized. In principle, however, the intended effect can be attained only by jetting of a compressed fluid from the jet nozzle 51*a*.

Referring to FIGS. 2 and 3, the cutting device 106 and 107 have a shape resembling scissors, and in each cutting device, a moving blade 54 is turned with a stationary pin 52 being as the fulcrum so that it traverses a stationary blade 53 to cut the yarn Y. When a rod 55 is operated by a control cam (not shown), a bifurcate lever 56 is turned clockwise or counterclockwise with a shaft 57 being as the fulcrum, and by moving a supporting pin 58 on the other end of the moving blade 54 by a fork portion 56*a* of the lever 56, the moving blade 54 is operated.

Fork guides 29 and 30 are arranged outside the yarn cutting devices 106 and 107, and guide grooves 59 and 60 are formed on the fork guides 29 and 30, respectively.

The yarn gathering lever 105 arranged on the side portion of the splicing device 12 is turned clockwise with a shift 31 being as the fulcrum when a rod 61 is operated by a control cam or the like (not shown), and the lever 105 thus guides the yarns YP and YB to the guide grooves 59 and 60.

The operations of the splicing apparatus having the above-mentioned structure will now be described in detail.

Figure 1:
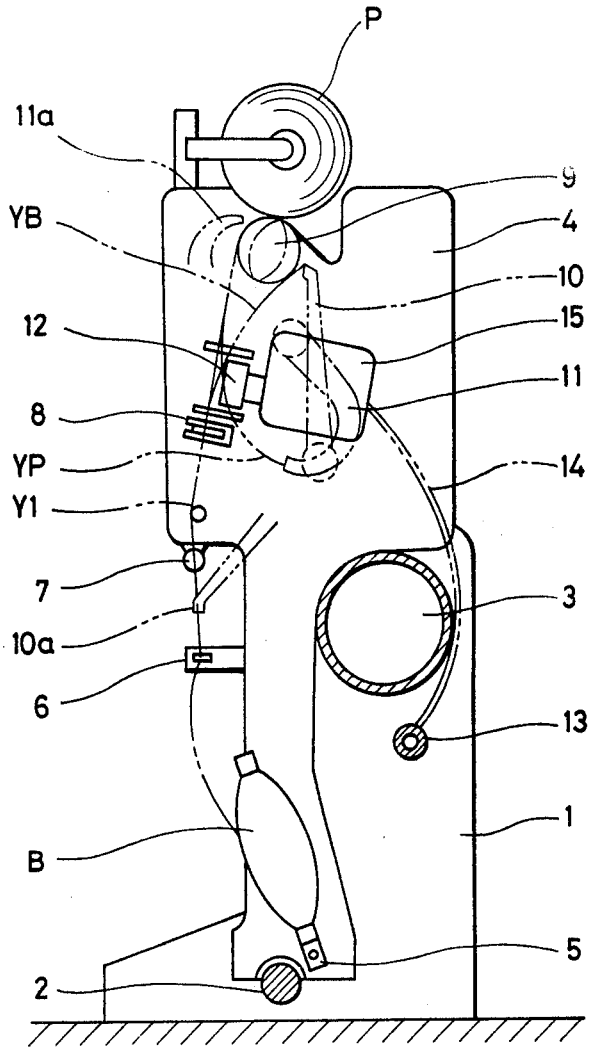
FIG. 1 is a side view illustrating diagrammatically one embodiment of the automatic winder provided with a splicing apparatus.

Referring to FIG. 1, when the detecting device 8 detecting yarn breakage during the rewinding operation or disappearance of the yarn layer on the bobbin detects that the yarn does not run, the drum 9 in stopped and simultaneously. a one-way rotation clutch (not shown) is actuated and various control cams mounted on a shaft rotating through said clutch or various cams co-operating with said shaft are operated to perform the splicing operation.

At first, the first and second yarn guide suction arms are turned from the positions 10*a* and 11*a* indicated by chain lines in FIG. 1 while the yarn ends are sucked into these suction arms, and these suction arms pass above the splicing apparatus 12 so that the yarn ends YB and YP on both the bobbin and package sides B and P traverse each other, and when both the yarn ends are guided to the positions outside the splicing apparatus 12, the first and second yarn guide suction arms are stopped.

As pointed out hereinbefore, both the first and second suction arms 10 and 11 are not simultaneously operated, but the yarn YP on the package side P is first sucked by the suction arm 11 and the suction arm 11 is stopped when it is turned to the position outside the splicing apparatus 12. After passage of a predetermined time, the yarn YB on the bobbin side B is sucked by the suction arm 10 and the suction arm 10 is stopped when it is turned to the position outside the splicing apparatus 12.

During a period of a predetermined time ranging from the point of completion of the operation of the second suction arm 11 to the point of initiation of the operation of the first suction arm 10, as shown in FIGS. 4 and 5, the turning lever 20 of the yarn supporting device 109 on the package side P is operated to grip the yarn YP between the turning lever 20 and supporting block 21, and simultaneously, the yarn YP is guided to the stationary guide 16 arranged in the vicinity of the detecting device 8 and the guide groove 19 of the turning guides 17 and 18. After checking is performed in the detecting device 8, the turning guides 17 and 18 are turned to points 17-1 and 18-1 indicated by chain lines with the shaft 22 being as the fulcrum, to remove the yarn YP from the detecting device 8 and fit it in the escape grooves 17*b* and 18*b*.

The first suction arm 10 sucks the yarn YB on the bobbin side B and it is turned to the point outside the splicing apparatus 12 and stopped there. At this time, the yarn YB is gripped between the supporting plate 23*a* and supporting block 23*b* of the yarn supporting device 108 through the hook portions 17*c* and 18*c* of the turning guides. 17 and 18. Accordingly, checking of the yarn YB on the bobbin side B by the detecting device 8 is not performed before the splicing operation but after completion of the splicing operation.

After termination of the operations of the first and second suction arms 10 and 11, the levers 32 and 33 of the yarn gathering lever 105 shown in FIGS. 2 through 6 are turned with the shaft 31 being as the fulcrum, and both the yarns YB and YP are independently guided to the guide grooves 59 and 60 of the fork guides 29 and 30 and they are inserted into the splicing hole 37 of the splicing member 101 through the slit 38.

Figure 6:
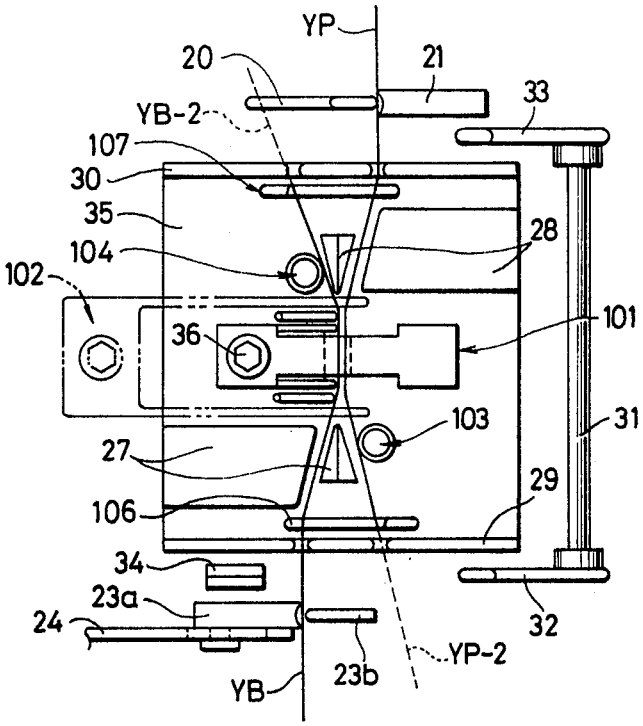
FIG. 6 is a partial side view of the splicing apparatus.
Figure 7:
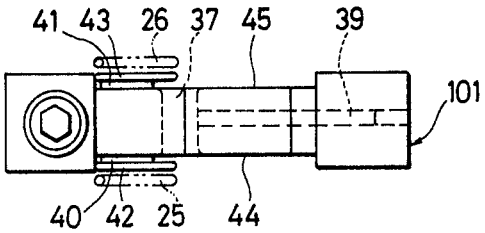
FIG. 7 is a plan view showing a splicing member.
Figure 8:
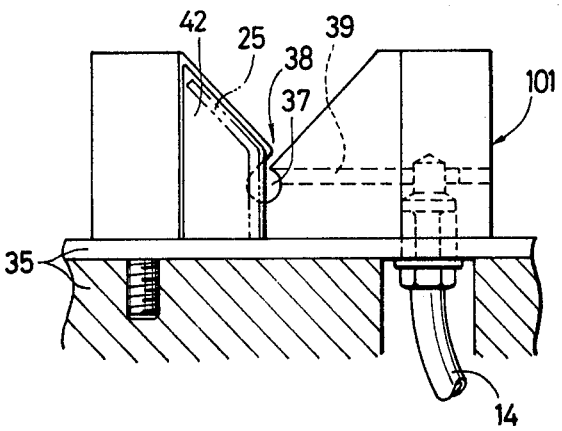
FIG. 8 is a side view showing a splicing member.
Figure 9:
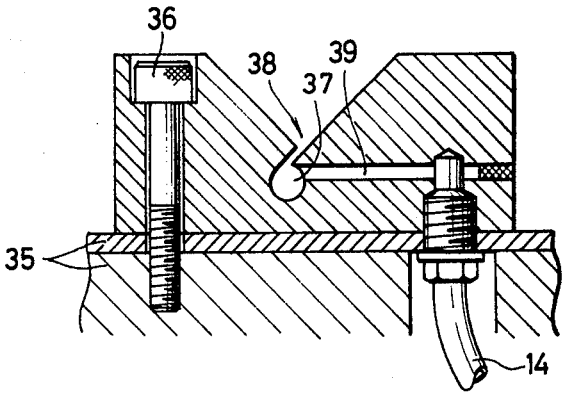
FIG. 9 is a sectional view of the splicing member shown in FIGS. 7 and 8.

Then, the yarns YB and YP are cut at points YB-2 and YP-2 apart by predetermined distances from the yarn supporting devices 108 and 109 by the cutting devices 106 and 107 as shown in FIG. 6. The yarn cutting positions have a relation to the length of the joint to be formed by splicing and have influences on the appearance and binding strength of the joint. The yarn cutting positions are determined according to the count number of the yarn.

Figure 19:
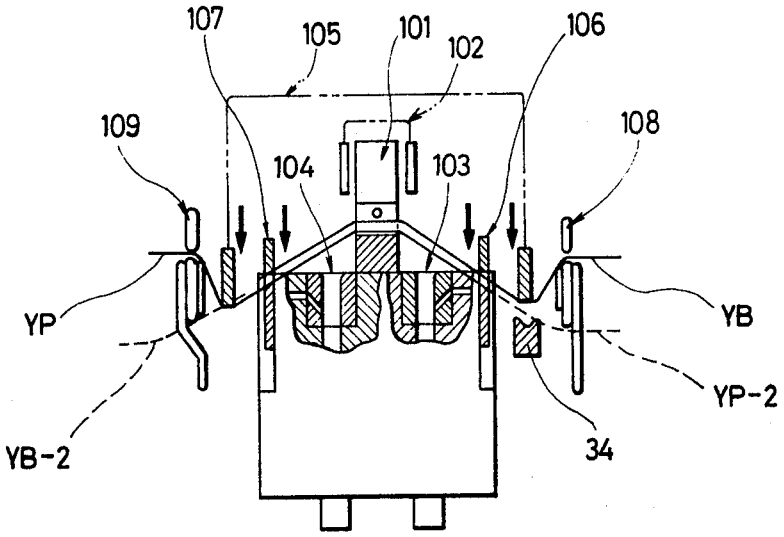
FIGS. 19 through 22 are diagrams illustrating the splicing operations.

Referring to FIG. 19, when both the yarns YB and YP are gripped by the yarn supporting devices 108 and 109 and the yarn gathering lever 105 is operated, the rod 61 shown in FIG. 5 is moved in a direction indicated by arrow A by a control cam (not shown) and cutting of the yarns is performed in the state where the levers 32 and 33 are turned clockwise with the shaft 31 being as the fulcrum. Incidentally, when the yarn gathering lever 105 and the yarn cutting devices 106 and 107 are operated, the clamping device 102 is located in the state where the clamping device 102 is turned with the shaft 46 being as the fulcrum by the operation of the rod 49 (in a direction indicated by arrow B) as shown in FIG. 5.

Figure 20:
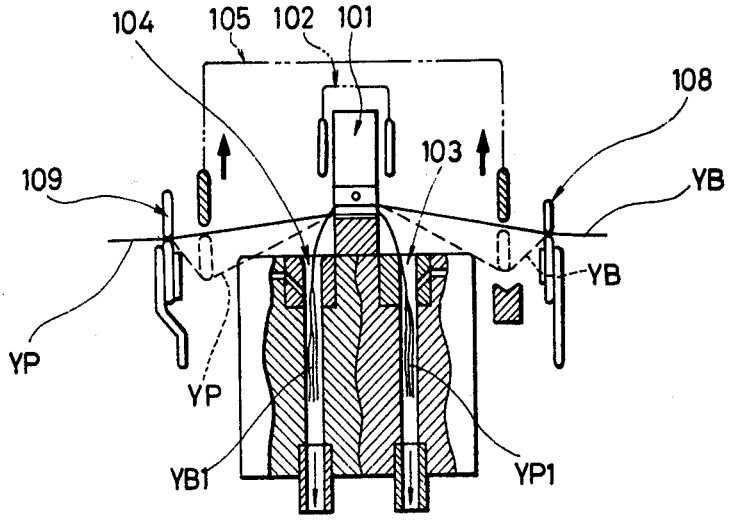

Then, as shown in FIG. 20, the yarn ends YB1 and YP1 are sucked by the control nozzles 103 and 104, and simultaneously with or just before or after this sucking operation, the yarn gathering lever 105 is turned in the direction separating from the yarn. Namely, as shown in FIG. 5, the yarn gathering lever 105 is turned counterclockwise with the shaft 31 being as the fulcrum by the operation of the rod 61 (in a direction indicated by arrow C), and the yarn gathering lever 105 separates from the yarn Y. At this time, as shown in FIG. 14, the yarn ends YB1 and YP1 are sucked into the nozzle hole 50*a* by the sucking action of the suction pipe 3 connected through the flexible pipe 50*b*, and simultaneously, the yarn ends YB1 and YP1 are untwisted in a state suitable for the splicing operation by a compressed fluid supplied from the pipe 13 and jetted from the jet nozzle 51*a* through the communicating holes 51*c* and 51*d* of the conduit 51*b*.

Incidentally, it is preferred that sucking of the yarn ends by the control nozzles 103 and 104 be initiated just before the yarns are cut by the cutting devices 106 and 107. Since the tension is given to the yarn Y by the sucking action of the suction arms 10 and 11 when the yarn Y is cut, there is a possibility that the yarn ends YB1 and YP1 are scattered by the cutting operation and separate from the positions of the control nozzles 103 and 104 and the operation of sucking the yarn ends YB1 and YP1 by the control nozzles 103 and 104 is not performed. Accordingly, although the control nozzles 103 and 104 may in principle be operated simultaneously with or after the yarn cutting operation, it is preferred that the control nozzles 103 and 104 be operated just before the yarn cutting operation. Supply of the fluid to the control nozzles 103 and 104 is accomplished by changeover of valves by the operation of solenoids (not shown).

Figure 21:
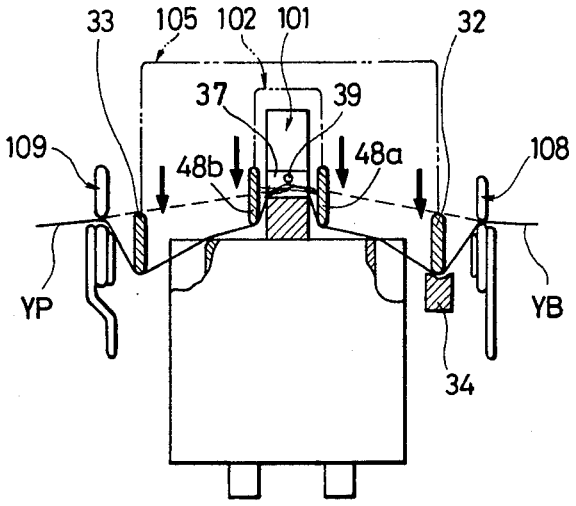

The yarn ends YB1 and YP1 are untwisted in a state suitable for splicing by the control nozzles 103 and 104 and the sucking actions of the control nozzles 103 and 104 are stopped. Simultaneously with or just before or after stopping of the sucking actions of the control nozzles 103 and 104, as shown in FIG. 21, the yarn gathering lever 105 is operated again to turn one lever 32 to the position falling into abutting contact with the stopper 34 while guiding both the yarn ends YB1 and YP1, and at the same time, the clamping device 102 is operated and turned to the position falling in abutting contact with the face of the bracket 35 as shown in FIGS. 12 and 13, while guiding the yarn ends YB1 and YP1. By one fork of the clamping plate 48, that is, the fork 48*a* on the side where the yarn Y is untwisted by the compressed fluid jetted from the jet nozzle hole 39 of the splicing member 101, the yarn Y is gripped to such an extent that untwisting is prevented. Since the compressed fluid acts on the yarn Y in the twisting direction on the side of the other fork 48*b*, the yarn Y need not particularly be gripped and it is sufficient if the yarn Y is clamped to such an extent that the position of the yarn is regulated.

Figure 22:
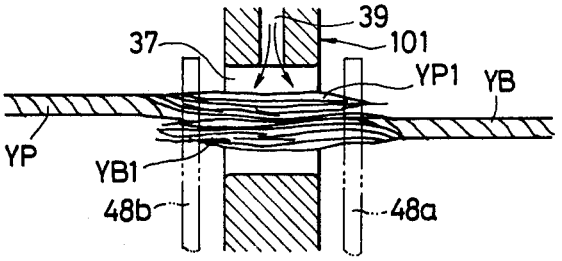

The yarn ends YB1 and YP1 inserted into the nozzle holes 50*a* of the control nozzles 103 and 104 by the operations of the yarn gathering lever 105 and clamping device 102 are attracted into the splicing hole 37 of the splicing member 101 and they are set in the state where both the yarn ends to be spliced are lapped as shown in FIG. 22. At this time, the length of the joint to be formed by splicing is determined according to the turning distances of the yarn gathering lever 105 and clamping device 102. Accordingly, the turning distances of the yarn gathering lever 105 and clamping device 102 are appropriately adjusted according to the count number of the yarn. Incidentally, from the viewpoint of the stability of the splicing operation, it is preferred that the position of clamping the yarn by the clamping plates 48*a* and 48*b* be in the vicinity of the top end of the lapped yarn ends YB1 and YP1, though the clamping position is not limited to this position.

By the action of the compressed fluid jetted from the jet nozzle hole 39 on the yarn ends YB1 and YP1 in the state set in the splicing hole 37, splicing is accomplished through the process described in detail with reference to FIGS. 10 and 11. After completion of the splicing operation, the yarn gathering lever 105 and clamping device 102 separate from the yarn Y and the yarn Y is returned to the above-mentioned rewinding state through the slit 38 of the splicing member 101.

Figure 23:
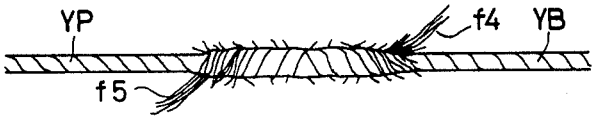
FIG. 23 is a diagram illustrating the structure of a joint formed according to the conventional method.
Figure 24:
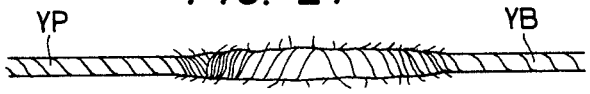
FIG. 24 is a diagram illustrating the structure of a joint formed according to the method of the present invention.

According to the present invention, since splicing is performed by the above-mentioned splicing method in which both the yarn ends YP and YB are untwisted in a state suitable for splicing by the sucking action of the control nozzles 103 and 104, the yarn ends YP and YB are clamped by the clamping device in the vicinity of the top end portion simultaneously with or just before or after stopping of the untwisting operation, and splicing is then effected by the action of a compressed fluid protrusions or angular portions f4 and f5 formed on both the ends of the joint by influences of the control nozzles as shown in FIG. 23, that is, angular portions of the unwrapped fiber bundles, are eliminated, and both the yarn ends are completely wrapped as shown in FIG. 24. Therefore, yarn breakage owing to the presence of the angular portions f4 and f5 and other disadvantages as described hereinbefore are not caused and the binding strength is improved.

As will be apparent from the foregoing description, the splicing method of the present invention is characterized in that before yarn ends on both the sides are subjected to the action of a compressed fluid, the yarn ends are untwisted in a state suitable for splicing by the control nozzles, the yarn ends are clamped in the vicinity of the top end portions thereof by the clamping device simultaneously with or just before or after stopping of the operation of the control nozzles, and the yarn ends are subjected to the action of the compressed fluid to effect splicing. Formation of angular portions in the vicinity of both the ends of the joint, which is a fatal defect of the conventional splicing method for performing splicing by the action of a compressed fluid, is prevented in the present invention by virtue of the above-mentioned characteristic feature because the angular portions are wrapped in the yarn end portions. Furthermore, since the fibers of the angular portions are wrapped in both the yarn ends, the binding strength of the resulting joint is increased. Moreover, since the yarn ends are clamped by the clamping device, failure in the splicing operation hardly occurs and the splicing operation can be performed very stably.

What is claimed is:

1. A method for splicing spun yarns in an automatic winder by sucking yarn ends on both the bobbin and package side into yarn end control nozzles respectively, inserting yarn ends into a yarn splicing nozzle and being subjected to an air jet to splice them in the yarn splicing nozzle, characterized in that the sucking action of the yarn end control nozzle is stopped when or after the treatment of the yarn ends is completed, and then a compressed fluid is jetted from the splicing nozzle to effect splicing.

2. A method for splicing spun yarns in an automatic winder comprising steps of gripping yarns on both the package and bobbin sides by yarn supporting devices respectively, cutting the yarn ends, sucking and untwisting said cut yarn ends by a yarn control nozzle, clamping the yarns in the vicinity of the yarn ends by a clamping device simultaneously with or just before or after stopping of the yarn-untwisting action in said control nozzle, and then subjecting an action of a compressed fluid to both the yarn ends lapped in a yarn splicing hole of a yarn splicing member to effect splicing.

3. A method for splicing spun yarns as claimed in claim 2, wherein the yarn ends are clamped to such an extent that untwisting caused by the ballooning action at the yarn splicing operation can be prevented.

4. A method for splicing spun yarns as claimed in claim 2, wherein the control nozzles are operated just before the yarn cutting operation.

5. A yarn splicing apparatus in an automatic winder comprising a splicing member arranged substantially at the center of the splicing apparatus and having a cylindrical splicing hole formed at the center thereof, a slit for insertion of the yarn ends and a jet nozzle formed to be opened tangentially to the splicing hole, a clamping device arranged beside the splicing member putting the splicing member therebetween for clamping and regulating the yarn in the vicinity of the yarn end, yarn control nozzles for introducing the cut yarn end by the sucking action therein to be untwisted, yarn cutting devices having a shape resembling scissors, a yarn gathering lever including a shaft and levers turning with the shaft being as the center, and yarn supporting devices comprising a movable supporting plate and a support block to grip the yarn therebetween, wherein said yarn control nozzles, said yarn cutting devices, said levers of the yarn gathering lever and said yarn supporting devices are arranged on both the sides of the splicing member and the clamping device in sequence.

6. A yarn splicing apparatus as claimed in claim 5, wherein the yarn splicing apparatus further includes control plates screwed to both the side of the splicing member through spacers to cover substantially the half of the sectional area of the splicing hole.

7. A yarn splicing apparatus as claimed in claim 5, wherein the clamping device comprises a clamping plate screwed to a turning lever capable of turning with a shaft fixed at a predetermined position as the fulcrum, said clamping plate having two fork-shaped portions on the top end thereof being different in configuration and clamping or regulating the yarn between the fork-shaped portion, a yarn guide pin and the top face of a bracket.

8. A yarn splicing apparatus as claimed in claim 5, wherein the yarn control nozzle comprises a nozzle hole, a suction pipe communicated with the nozzle hole, and a jet nozzle opened slantingly to the nozzle hole, said nozzle hole comprising a sleeve with a jet hole of the jet nozzle and a supporting block provided with two communicating holes communicated with the jet hole of the sleeve and formed at a deviation angle of about 90° and rotatably supporting the sleeve therein.

9. A device for splicing together a first end of yarn and a second end of yarn, each of said ends including several entangled strands of fiber, said device comprising:

disentangling means for separating said entangled strands of fiber of each of the ends and aligning them in a substantially parallel manner;

positioning means for aligning said first and second yarn ends adjacent each other, in an overlapping manner, and facing in essentially opposite directions;

compressed fluid splicing means for entangling the separated strands of fiber from said first yarn end with the separated strands of fiber from said second yarn end to thereby splice said first and second yarn ends together, wherein said splicing means further comprises:

a splicing nozzle including an substantially cylindrical interior space into which the yarn ends are inserted and at least one nozzle hole for directing compressed fluid into the interior space in a direction substantially tangential to the interior space, whereby compressed fluid forced through said nozzle hole creates a swirling fluid stream by which said strands of fiber of said yarn ends are entangled; and a pair of guide pins located at either end of the interior space and partially overlapping the interior space, said guide pins preventing said yarn ends from flying out of said interior space during a splicing operation.

* * * * *

REEXAMINATION CERTIFICATE (1247th)

United States Patent [19] [11] B1 4,411,128

Mima [45] Certificate Issued Apr. 10, 1990

[54] METHOD AND APPARATUS FOR SPLICING SPUN YARNS

[75] Inventor: Hiroshi Mima, Joyo, Japan

[73] Assignee: Murata Kikai Kabushiki Kaisha, Kyoto, Japan

Reexamination Request:
No. 90/001,801, Jun. 26, 1989

Reexamination Certificate for:

| | |
|---|---|
| Patent No.: | **4,411,128** |
| Issued: | **Oct. 25, 1983** |
| Appl. No.: | **304,848** |
| Filed: | **Sep. 23, 1981** |

[30] Foreign Application Priority Data

Sep. 26, 1980 [JP] Japan ..... 55-134986

[51] Int. Cl.[4] ..... D01H 15/00

[52] U.S. Cl. ..... 57/22; 57/261; 242/37 A

[58] Field of Search ..... 57/22, 23, 261, 262, 57/263, 301, 302; 242/35.5 R, 35.6 R, 37, 147 A

[56] References Cited

U.S. PATENT DOCUMENTS

| | | | |
|---|---|---|---|
| Re. 31,594 | 6/1984 | Mima . | |
| 2,362,801 | 11/1944 | Charnock . | |
| 2,515,172 | 7/1950 | Abbott . | |
| 2,705,656 | 4/1955 | Shockey . | |
| 3,198,446 | 8/1965 | Furst et al. . | |
| 3,307,339 | 3/1967 | Porter . | |
| 3,315,458 | 4/1967 | Alexander . | |
| 3,345,809 | 10/1967 | Gemeinhart et al. . | |
| 3,379,002 | 4/1968 | Rosenstein . | |
| 3,407,583 | 10/1968 | Irwin . | |
| 3,461,661 | 8/1969 | Irwin . | |
| 3,474,615 | 10/1969 | Irwin et al. | 57/22 X |
| 3,477,217 | 11/1969 | Bell et al. . | |
| 3,487,618 | 1/1970 | Arguelles | 57/22 |
| 3,599,886 | 8/1971 | Koller | 242/35.5 R |
| 3,695,017 | 10/1972 | Hori et al. . | |
| 3,732,678 | 5/1973 | Berry | 57/22 |
| 3,867,810 | 2/1975 | Meertens et al. | 57/22 X |
| 3,903,680 | 9/1975 | Isern . | |
| 3,949,946 | 4/1976 | Rohner et al. | 242/35.6 X |
| 3,962,855 | 6/1976 | Stahlecker . | |
| 4,121,409 | 10/1978 | Uchida et al. | 57/22 |
| 4,170,103 | 10/1979 | Norris et al. . | |
| 4,217,749 | 8/1980 | Rohner . | |
| 4,229,935 | 10/1980 | Wain . | |
| 4,240,247 | 12/1980 | Matsui et al. . | |
| 4,244,169 | 1/1981 | Ligones et al. . | |

FOREIGN PATENT DOCUMENTS

| | | |
|---|---|---|
| 2444973 | 4/1975 | Fed. Rep. of Germany . |
| 2203198 | 8/1975 | Fed. Rep. of Germany . |
| 623290 | 5/1981 | Switzerland . |
| 2018846 | 10/1979 | United Kingdom . |

OTHER PUBLICATIONS

Textile Month Jul. 1978, at pages 6 and 63, Pentwyn, Model 201, 203 and 205 Pneumatic Yarn Splicer manual, Leesona, No. 275, Yarn Air Splicer manual.

*Primary Examiner*—Joseph J. Hail, III

[57] ABSTRACT

Pneumatic yarn splicing method and apparatus for spun yarns. Suction nozzles for controlling yarn ends are arranged on both the sides of a splicing nozzle with a nozzle hole for jetting a compressed fluid. The sucking action of the yarn end control nozzle is stopped when or after the treatment of the yarn ends is completed, and then, a compressed fluid is jetted from the splicing nozzle to effect splicing.

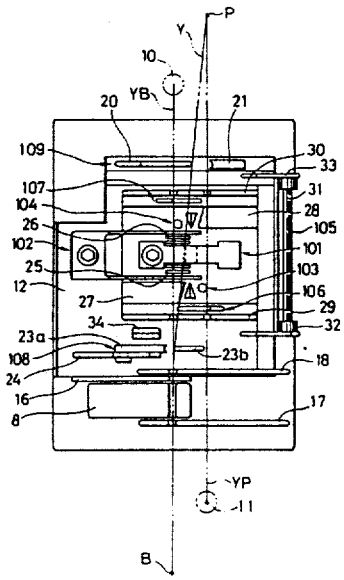

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 1 is confirmed.

Claims 2, 5 and 9 are determined to be patentable as amended.

Claims 3, 4 and 6–8, dependent on an amended claim, is determined to be patentable.

New claims 10 and 11 are added and determined to be patentable.

2. A method for splicing spun yarns in an automatic winder comprising steps of gripping yarns on both the package and bobbin sides by yarn supporting devices respectively, cutting the yarn ends, sucking and untwisting said cut yarn ends by a yarn control nozzle, clamping the yarns in the vicinity of the yarn ends by a clamping device simultaneously with or just before or after stopping of the [yarn untwisting action] *suction* in said control nozzle, and then subjecting an action of a compressed fluid to both the yarn ends lapped in a yarn splicing hole of a yarn splicing member to effect splicing.

5. A yarn splicing apparatus in an automatic winder comprising a splicing member arranged substantially at the center of the splicing apparatus and having a cylindrical splicing hole formed at the center thereof, a slit for insertion of the yarn ends and a jet nozzle formed to be opened tangentially to the splicing hole *for jetting compressed air into the splicing hole to thereby splice together two ends of yarn situated therein,* a clamping device arranged beside the splicing member putting the splicing member therebetween for clamping and regulating the yarn in the vicinity of the yarn end *before compressed air is jetted into the splicing hole,* yarn control nozzles for indroducing the cut yarn end by the sucking action therein to be untwisted, *wherein said suction action is terminated just before the yarn ends are clamped,* yarn cutting devices having a shape resembling scissors, a yarn gathering lever including a shaft and levers turning with the shaft being [as] *at* the center, and yarn supporting devices comprising a movable supporting plate and a support block to grip the yarn therebetween, *and* wherein said yarn control nozzles, said yarn cutting devices, said levers of the yarn gathering lever and said yarn supporting devices are arranged on both the sides of the splicing member and the clamping device in sequence*; and*

*control means for automatically terminating the suction action in the yarn control nozzles prior to initiating the jetting of the compressed air into the splicing hole.*

9. A device for splicing together a first end of yarn and a second end of yarn, each of said ends including several entangled strands of fiber, said device comprising:

disentangling means *for subjecting the yarn ends to a suction force* for separating said entangled strands of fiber of each of the ends and aligning them in a substantially parallel manner, *and then terminating said suction force;* positioning means for aligning said first and second yarn ends adjacent each other, in an overlapping manner, and facing in essentially opposite directions *after said suction force is terminated;* compressed fluid splicing means for, *after said aligning of said first and second yarn ends,* entangling the separated strands of fiber from said first yarn end with the separated strands of fiber from said second yarn end to thereby splice said first and second yarn ends together, wherein said splicing means further comprises:

a splicing nozzle including an substantially cylindrical interior space into which the yarn ends are inserted and at least one nozzle hole for directing compressed fluid into the interior space in a direction substantially tangential to the interior space, whereby compressed fluid forced through said nozzle hole creates a swirling fluid stream by which said strands of fiber of said yarn ends are entangled; and a pair of guide pins located at either end of the interior space and partially overlapping the interior space, said guide pins preventing said yarn ends from flying out of said interior space during a splicing operation*; and*

*control means for automatically terminating the suction action in the yarn control nozzles prior to initiating the jetting of the compressed air into the splicing hole.*

*10. A method for splicing spun yarns in an automatic winder by sucking yarn ends on both the bobbin and package side into yarn end control nozzles respectively, inserting yarn ends into a yarn splicing nozzle and being subjected to an air jet to splice them in the yarn splicing nozzle, characterized in that the sucking action of the yarn end control nozzle is stopped when the treatment of the yarn ends is completed, and then a compressed fluid is jetted from the splicing nozzle to effect splicing.*

*11. A method for splicing spun yarns in an automatic winder by sucking yarn ends on both the bobbin and package side into yarn end control nozzles respectively, inserting yarn ends into a yarn splicing nozzle and being subjected to an air jet to splice them in the yarn splicing nozzle, characterized in that the sucking action of the yarn end control nozzle is stopped after the treatment of the yarn ends is completed, and then a compressed fluid is jetted from the splicing nozzle to effect splicing.*

* * * * *